United States Patent [19]

Swanson

[11] Patent Number: 4,788,519

[45] Date of Patent: Nov. 29, 1988

[54] EXHAUST CONTROL DEVICE FOR CIRCUIT INTERRUPTER

[75] Inventor: Roy T. Swanson, N. Riverside, Ill.

[73] Assignee: S & C Electric Company, Chicago, Ill.

[21] Appl. No.: 60,720

[22] Filed: Jun. 10, 1987

[51] Int. Cl.[4] ..... H01H 85/38

[52] U.S. Cl. ..... 337/280; 200/148 C

[58] Field of Search ..... 337/280, 275, 281, 282; 200/148 C, 150 H

[56] References Cited

U.S. PATENT DOCUMENTS

| | | | |
|---|---|---|---|
| 3,258,568 | 6/1966 | Patterson et al. | 337/280 |
| 3,719,912 | 3/1973 | Harner et al. | 337/280 |
| 3,909,570 | 9/1975 | Harner et al. | 200/144 |
| 3,965,452 | 6/1976 | Chabala et al. | 337/280 |
| 4,001,750 | 1/1977 | Scherer et al. | 337/280 |
| 4,103,129 | 7/1978 | Evans et al. | 200/144 |

*Primary Examiner*—H. Broome

*Attorney, Agent, or Firm*—James V. Lapacek

[57] ABSTRACT

An exhaust-control device is provided to absorb the energy of exhaust gases released during operation of a circuit-interrupting device such as a power fuse or an expulsion fuse. The exhaust-control device includes a first heat-absorbing medium through which the exhaust gases pass for reducing the temperature of the exhaust gases below a predetermined temperature. The exhaust-control device further includes a second heat-absorbing medium for receiving the exhaust gases exiting from the first heat-absorbing medium. The material, quantity, size distribution, and arrangement of the first heat-absorbing medium is selected so that the predetermined temperature of the exhaust gases does not cause significant melting of the second heat-absorbing medium that is utilized. In a specific arrangement, the first heat-absorbing medium is a section of ceramic pellets and the second heat-absorbing medium is a roll of woven copper mesh.

15 Claims, 2 Drawing Sheets

EXHAUST CONTROL DEVICE FOR CIRCUIT INTERRUPTER

BACKGROUND OF THE INVENTION

Field of the Invention

The present invention relates to exhaust-control devices for circuit-interrupting devices such as fuses, and more particularly to an exhaust-control device that utilizes a first heat-absorbing medium to cool the exhaust so as to avoid any significant melting of or deleterious effects to a second heat-absorbing medium through which the exhaust passes after passing through the first heat-absorbing medium.

Related Art

During operation of a circuit-interrupting device such as a fuse, hot arc products and gases are discharged which will be generally referred to as "exhaust gases" hereinafter. In many applications, it is desirable to prevent discharge of these exhaust gases into the atmosphere or local environment. Specifically, it is desirable to reduce the noise level during operation and to absorb substantially all of the energy of the exhaust gases, thus preventing the hot arc products and metallic vapors in the exhaust gases from entering the environment. Exhaust-control devices of the type that perform these functions are disclosed in U.S. Pat. Nos. 3,719,912, 3,909,570, 3,965,452, 4,001,750, and 4,103,129. This type of exhaust-control device reduces the sound level and the gas discharge without significantly interfering with the intended circuit-interrupting function of the fuse or device. Further, this type of exhaust-control device, unlike non-vented devices, does not create unsuitably high back pressures to the circuit-interrupting device which might cause undesirable effects, including higher pressures and operating temperatures, longer arcing time, and higher operating energies that must be dissipated.

It is also desirable that the exhaust-control device be as small and light-weight as possible, while retaining efficiency of operation and being capable of functioning repeatedly without loss of effectiveness.

However, if a heat-absorbing medium that has a melting point below the highest temperature of the exhaust gases is utilized, as is the case for example with woven copper mesh or screen, sufficient heat-absorbing medium must be provided so that the exhaust-control device is capable of functioning after a portion of the heat-absorbing medium is melted. This, of course, requires a larger quantity and volume of heat-absorbing medium than would be required if the heat-absorbing medium were not melted at all by the hot exhaust gases. If a heat-absorbing medium that has a higher melting point is utilized, for example ceramic pellets or balls, the ceramic medium is not readily available in shapes that optimize the flow of exhaust gases or the transfer of heat into the ceramic medium. Additionally, the melting temperature of the ceramic medium is not high enough to totally eliminate melting at the temperature of the exhaust gases. Accordingly, the ceramic medium also tends to plug up when the circuit-interrupting device interrupts high currents. The relatively low thermal conductivity and low specific heat at lower temperatures also are drawbacks of a ceramic medium.

SUMMARY OF THE INVENTION

Accordingly, it is a principal object of the present invention to provide an exhaust-control device which is smaller, lighter, and more economical than the devices of the prior art while being capable of repeated functioning without loss of effectiveness.

It is another object of the present invention to provide an exhaust-control device that includes a first heat-absorbing medium to cool the exhaust gases so as to avoid any significant melting of or deleterious effects to a second heat-absorbing medium through which the exhaust gases pass after passing through the first heat-absorbing medium.

These and objects of the present invention are efficiently achieved by the provision in an exhaust-control device for a circuit-interrupting device of a first heat-absorbing medium through which exhaust gases pass for reducing the temperature of the exhaust gases below a predetermined temperature, which is determined in accordance with the properties of a second heat-absorbing medium through which the exhaust gases pass after passing through the first heat-absorbing medium. The quantity, size, distribution, and arrangement of the first heat-absorbing medium is selected so as to avoid significant melting of or deleterious effects to the second heat-absorbing medium. The melting point of the first heat-absorbing medium is higher than the melting point of the second heat-absorbing medium. In a specific arrangement, the first heat-absorbing medium is arranged as a section of ceramic pellets or generally spherical members (e.g., alumina balls) and the second heat-absorbing medium is arranged as a section of a metallic screen or woven open mesh (e.g., copper).

DETAILED DESCRIPTION

Figure 1:
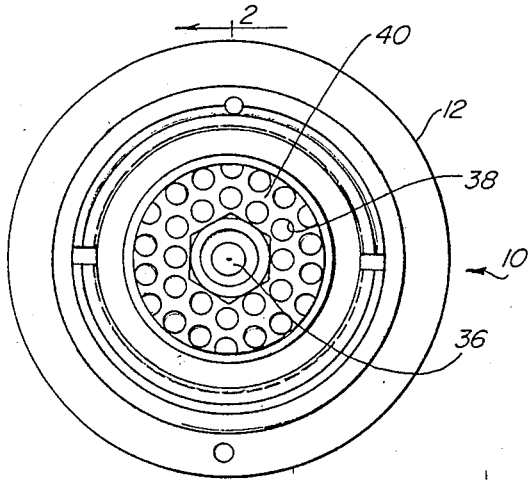
FIG. 1 is an elevational view of an exhaust-control device fabricated in accordance with the principles of the present invention.
Figure 2:
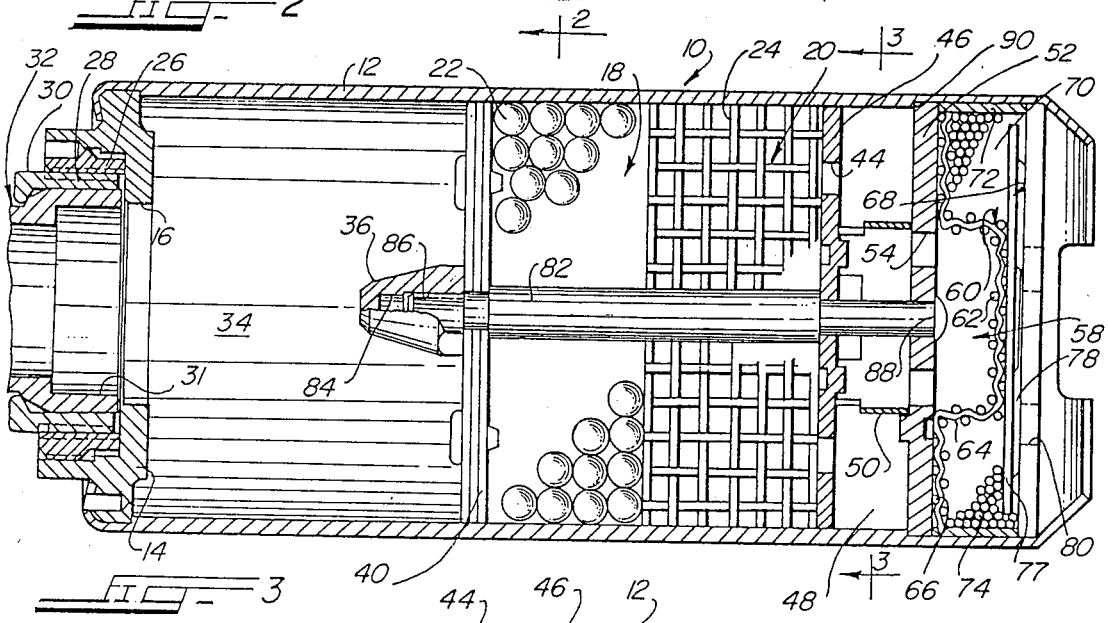
FIG. 2 is a sectional view taken along the line 2—2 of FIG. 1.

Referring now to FIGS. 1 and 2, the exhaust-control device 10 of the present invention includes a housing 12. The housing 12 includes an end wall 14 that defines an intake port 16. The exhaust-control device 10 includes two sections or layers of heat-absorbing medium or materials, a first section 18 and a second section 20. The sections 18 and 20 can also be referred to as heat sinks. Hot exhaust gases entering the intake port 16 pass through the first section 18 and thereafter pass through the second section 20. The temperature of the exhaust gases is reduced by passage through the first section 18 and is further reduced by passage through the second section 20.

In accordance with important aspects of the present invention, the first section 18 of heat-absorbing medium cools the exhaust gases sufficiently so as to avoid any significant melting of or deleterious effects to the heat-absorbing medium of the second section 20. For example, if the exhaust gases entering the intake port 16 have a first predetermined maximum temperature $T_1$, then the exhaust gases exiting the first section 18 and entering the second section 20 do not exceed a second predetermined temperature $T_2$, lower than the first predetermined maximum temperature $T_1$. The second predetermined temperature $T_2$ is below a third predetermined temperature $T_3$, which represents either the melting point of the heat-absorbing material or a temperature below which deleterious effects are avoided. The third predetermined temperature $T_3$ is also below the first predetermined maximum temperature $T_1$. Thus, the exhaust-control device 10 is capable of functioning repeatedly without significant loss of effectiveness.

In a specific embodiment, the heat-absorbing medium of the first section 18 is ceramic, for example, in the form of generally spherical elements 22 of tabular alumina having a generally uniform dimension of approximately one-quarter of an inch. The heat-absorbing medium of the second section 20 is a roll of woven copper mesh 24. The mesh 24 may also be characterized as an open lattice or a screen. Accordingly, the size, size distribution (if any), and heat-absorbing characteristics of the heat-absorbing medium of the first section 18 and the volume of the first section 18 are selected in accordance with the characteristics of the heat-absorbing material of the second section 20. The volume of the ceramic heat-absorbing medium in the first section 18 avoids any accumulation of molten ceramic material that might cause plugging and an undesirable increase in back pressure. Any molten ceramic material that might be blown into the second section 20 does not cause plugging due to the geometry and arrangement of the woven copper mesh 24. Further, the ceramic medium is utilized at high temperatures, such that the factors of the relatively low thermal conductivity and less than optimum shape of the ceramic medium are not as significant. The ceramic medium also has a higher specific heat at higher temperatures. The parameters and characteristics of the heat-absorbing media or material of the first and second sections 18 and 20 and the volume of the first and second sections 18 and 20 can be varied to provide the optimal overall volume for the first and second sections 18 and 20 of the exhaust-control device 10 to achieve the desired cooling of the exhaust gases.

For example, if the volume of the first and second sections 18 and 20, as shown in FIG. 2, were filled entirely with the woven copper mesh 24, then for a given temperature $T_1$ of the exhaust gases at the intake port 16, the woven copper mesh 24 would experience significant melting. Accordingly, the effectiveness of the device would then be reduced for subsequent operations. Alternatively, if the volume of the first and second sections 18 and 20 were filled entirely with tabular alumina elements 22, the cooling would not be sufficient and the exhaust-control device 10 would tend to plug up.

Turning now to the specific embodiment of the exhaust-control device 10 illustrated in FIGS. 1–4, the structural aspects of which are not to be interpreted in any limiting sense, the end wall 14 includes provisions, e.g., threads 26, for engagement with threads 28 of a locking collar 30 which is affixed to a circuit interrupter, such as a fuse 32. When the fuse 32 operates, energy is produced in the form of heat, light, and sound with hot exhaust gases (i.e., arc products) being expelled through a hollow exhaust extension 31 of the fuse 32. The quantity of energy produced by the operation of the fuse 32 varies with the circuit voltage, the magnitude of current being interrupted, and the point of the alternating-current wave at which the fault is initiated; e.g., overcurrent resulting from a fault condition. If the fuse 32 utilizes a fusible metallic element, arcing rod, etc., the exhaust gases will contain metallic vapors.

The hot exhaust gases exiting the exhaust extension 30 and passing through the intake port 16 are initially received in a gas expansion chamber 34. The arc produced during the operation of the fuse 32 may be blown into the exhaust-control device 10 by the inrush of exhaust gases, and this arc tends to settle on a conductive arcing tip 36 that is provided for this purpose and disposed within the gas expansion chamber 34 and along the center of the exhaust-control device 10. The exhaust gases then pass through the circular openings 38 of an upper baffle plate 40 and into the first section 18 of heatabsorbing material. The heat-absorbing material 22 absorbs substantial energy from the exhaust gases, resulting in a substantial drop in the temperature of the exhaust gases exiting the first section 18 and passing into the second section 20. The temperature of the exhaust gases leaving the first section 18 and entering the second section 20 is below the third predetermined temperature $T_3$, such that the woven copper mesh 24 is either not melted or does not experience significant melting or other deleterious effects. The exhaust gases then pass through the second section 20 and are further cooled.

Figure 3:
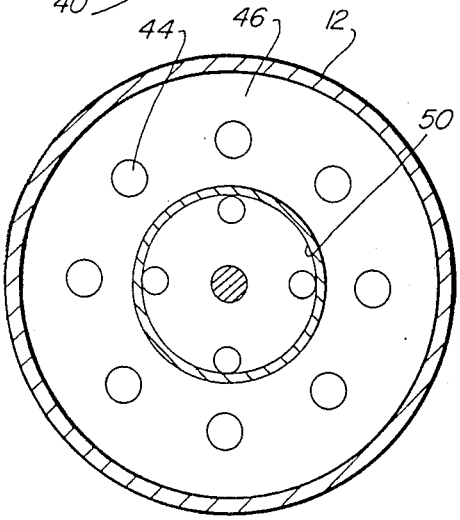
FIG. 3 is a sectional view taken along the line 3—3 of FIG. 2.
Figure 4:
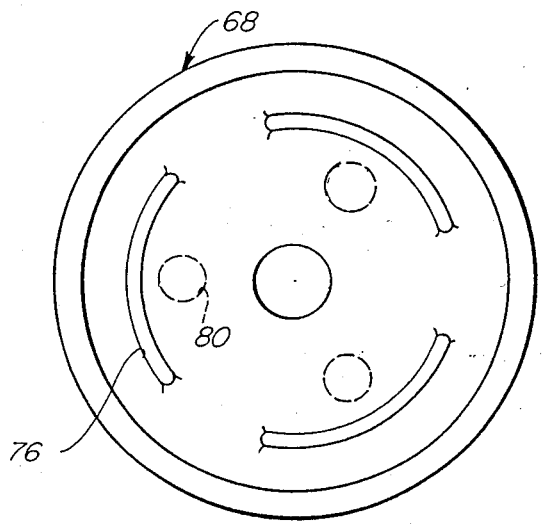
FIG. 4 is an elevational view of the lower baffle assembly of the exhaust-control device of FIGS. 1 and 2.

The exhaust gases, after passing through the second section 20, pass through the holes 44 of a diverter plate 46; in a specific embodiment, the pattern of holes 44 being arranged as shown in FIG. 3. After passing through the diverter plate 46, the exhaust gases enter a middle chamber 48. The middle chamber 48 is defined by the housing 12, the diverter plate 46, a spacer 50, and a middle baffle plate 52. The exhaust gases pass through the middle chamber 48 through the holes 54 of a middle baffle plate 52 and into a lower chamber 58. The lower chamber 58 is defined by the middle baffle plate 52, a circumferential cup-shaped screen member 60, and the housing 12. The screen member 60 includes a bottom wall 62, a circumferential side wall 64, and a rim 66. The rim 66 is positioned against the middle baffle plate 52 and the bottom wall 62 is positioned against a lower baffle assembly 68, which is shown in more detail in FIG. 4. The toriodal volume 70, between the screen member 60 and a sleeve 72 adjacent the housing 12, includes absorbent material; in a specific embodiment, generally spherical ceramic elements such as alumina balls 74 of approximately 0.1 inch in diameter are provided. The lower baffle assembly 68 includes a front baffle member 77 with circumferential slots 76 (FIG. 4) and a baffle member 78 with holes 80.

The exhaust gases passing through the lower chamber 58 pass through the ceramic material (e.g., 74) in the volume 70 and then through the labyrinth path defined through the slots 76 and the holes 80 of the lower baffle assembly 68. The holes 80 function as exhaust ports. The exhaust gases then pass out to the enrivonment of the exhaust-control device 10 and the fuse 32. Reference may be made to U.S. Pat. Nos. 3,965,452 and 4,001,750 for a more detailed discussion.

Concerning additional structural aspects of the exhaust-control device 10, a stud 82 includes a threaded end 84 which threads into a threaded passage 86 of the arcing tip 36. A fastener 88 is affixed to the other end of the stud 82; the fastener passing through the middle baffle plate 56 and into the stud 82. The middle baffle plate 56 is affixed in the housing 12 by means of a shoulder 90 of the housing 12 and the sleeve 72.

While there has been illustrated and described various embodiments of the present invention, it will be apparent that various changes and modifications will occur to those skilled in the art. For example, the exhaust-control device 10 is illustrative only and it should be realized that the present invention can be practiced with exhaust-control devices 10 of other construction and configurations that provide a first layer or section of heat-absorbing material and a second layer or section of heat-absorbing material. Accordingly, the disclosure of the exhaust-control device 10 should not be interpreted in any limiting sense. It is intended in the appended claims to cover all such changes and modifications as fall within the true spirit and scope of the present invention.

What is claimed and desired to be secured by Letters Patent of the United States is:

1. An exhaust-control device for a circuit interrupter that expels exhaust gases during operation, the exhaust-control device comprising:

a housing defining inlet means for receiving exhaust gases from the circuit interrupter;

a first section of ceramic material supported by said housing adjacent said inlet means for receiving the exhaust gases and through which the exhaust gases pass; and a second section of metallic heat-absorbing material supported by said housing and arranged with respect to said first section to receive the exhaust gases from said first section.

2. The exhaust-control device of claim 1 wherein said ceramic material comprises a plurality of ceramic pellets.

3. The exhaust-control device of claim 2 wherein said metallic heat-absorbing material comprises an open lattice structure having a plurality of layers.

4. The exhaust-control device of claim 1 wherein said first section of ceramic material reduces the temperature of the exhaust gases below a predetermined temperature at which deleterious effects can occur to said metallic heat-absorbing material.

5. The exhaust-control device of claim 1 wherein said first section of ceramic material reduces the temperature of the exhaust gases below the melting point of said metallic heat-absorbing material.

6. An exhaust-control device for a circuit interrupter that expels exhaust gases during operation, the exhaust-control device comprising:

a housing defining inlet means for receiving exhaust gases from the circuit interrupter;

first means supported by said housing adjacent said inlet means for receiving the exhaust gases which pass therethrough and for reducing the temperature of the exhaust gases so that on exiting said first means, the exhaust gases are below a predetermined temperature, said first means comprising a first heat-absorbing medium, said first heat-absorbing medium comprising a plurality of members arranged in a plurality of layers; and second means supported by said housing and arranged with respect to said first means to receive the exhaust gases exiting from said first means and further reducing the temperature of the exhaust gases that pass through said second means, said second means comprising a second heat-absorbing medium, said predetermined temperature being determined as a function of the properties of said second heat-absorbing medium, said first and second heat-absorbing media having predetermined melting points, the predetermined melting point of said first heat-absorbing medium being higher than said predetermined melting point of said second heat-absorbing medium.

7. The exhaust-control device of claim 6 wherein said predetermined temperature is below said predetermined melting point of said second heat-absorbing medium.

8. The exhaust-control device of claim 6 wherein said housing is vented adjacent said second means.

9. The exhaust-control device of claim 6 wherein said first heat-absorbing medium comprises a plurality of ceramic members.

10. The exhaust-control device of claim 9 wherein said ceramic members are generally spherical.

11. The exhaust-control device of claim 9 wherein said second heat-absorbing medium comprises a metallic screen.

12. The exhaust-control device of claim 6 wherein said predetermined temperature is determined to avoid significant melting of said second heat-absorbing medium.

13. An exhaust-control device for a circuit interrupter that exhausts gases during operation comprising:

a housing defining inlet means for receiving exhaust gases from the circuit interrupter;

first means supported within said housing adjacent said inlet means for receiving the exhaust gases and for reducing the temperature of the exhaust gases, said first means comprising a plurality of members of a first heat-absorbing material arranged in a plurality of layers; and second means supported within said housing and arranged with respect to said first means to receive the exhaust gases exiting said first means and for further reducing the temperature of the exhaust gases, said second means comprising second heat-absorbing material, said first and second heat-absorbing materials having predetermined melting points, the predetermined melting point of said first heat-absorbing material being higher than the predetermined melting point of said second heat-absorbing material.

14. The exhaust-control device of claim 13 wherein said second heat-absorbing material includes properties that are defined in terms of a predetermined temperature at which deleterious effects can occur, said first means reducing the temperature of the exhaust gases below said predetermined temperature.

15. The exhaust-control device of claim 14 wherein said predetermined temperature is the melting point of said second heat-absorbing material.

* * * * *